US010750853B1

(12) United States Patent
Wood

(10) Patent No.: US 10,750,853 B1
(45) Date of Patent: Aug. 25, 2020

(54) BROOM WITH LIGHT

(71) Applicant: Michael Anthony Wood, Cody, WY (US)

(72) Inventor: Michael Anthony Wood, Cody, WY (US)

( * ) Notice: Subject to any disclaimer, the term of this patent is extended or adjusted under 35 U.S.C. 154(b) by 77 days.

(21) Appl. No.: 16/270,399

(22) Filed: Feb. 7, 2019

(51) Int. Cl.
*A46B 15/00* (2006.01)
*F21V 33/00* (2006.01)

(52) U.S. Cl.
CPC ..... *A46B 15/0036* (2013.01); *A46B 15/0044* (2013.01); *A46B 2200/302* (2013.01); *F21V 33/0044* (2013.01)

(58) Field of Classification Search
CPC . A46B 15/00; A46B 15/0002; A46B 15/0016; A46B 15/0034; A46B 15/0036; A46B 15/0044; A46B 2200/302; F21V 33/0004; F21V 33/0024; F21V 33/0044
USPC ..... 15/105, 159.1, 171, 175; 362/109, 119, 362/120
See application file for complete search history.

(56) References Cited

U.S. PATENT DOCUMENTS 2,168,671 A 8/1939 Garlington
7,914,167 B2 3/2011 Petersen
8,707,499 B2 4/2014 Clark
9,414,669 B2 8/2016 Fleischer
9,638,411 B2 5/2017 Saltalamacchia
9,681,744 B2 6/2017 Russell et al.
2006/0215390 A1 9/2006 Jones et al.
2006/0215391 A1 9/2006 Jones et al.
2009/0059569 A1 3/2009 Quattrini, Jr.
2010/0027246 A1 2/2010 Petersen
2012/0151702 A1 6/2012 Clark
2012/0227197 A1 9/2012 Fleischer
2012/0294470 A1 11/2012 Saltalamacchia
2013/0198991 A1 8/2013 Cadigan
2016/0278640 A1 9/2016 Russell et al.
2018/0271268 A1* 9/2018 Caswell ..... A47L 9/2884

* cited by examiner

*Primary Examiner* — Mark Spisich
(74) *Attorney, Agent, or Firm* — Antoinette M. Tease

(57) ABSTRACT

A broom with a brush section and a brush cap into which the upper ends of a plurality of bristles are mounted, a plurality of white-light LEDs, a shaft, a rechargeable battery, an on/off switch, and a printed circuit board. The plurality of white-light LEDs are arranged in two rows around a perimeter of a bottom of the brush cap. The bristles are arranged in clusters, and each cluster is inserted into a hole in the bottom of the brush cap. The ten white-light LEDs are mounted into the bottom of the brush cap at preset, individual orientations so that a central axis of a light beam from each LED is oriented in a direction that is parallel to the bristles that are closest to that particular LED.

13 Claims, 4 Drawing Sheets

FIGURE 1
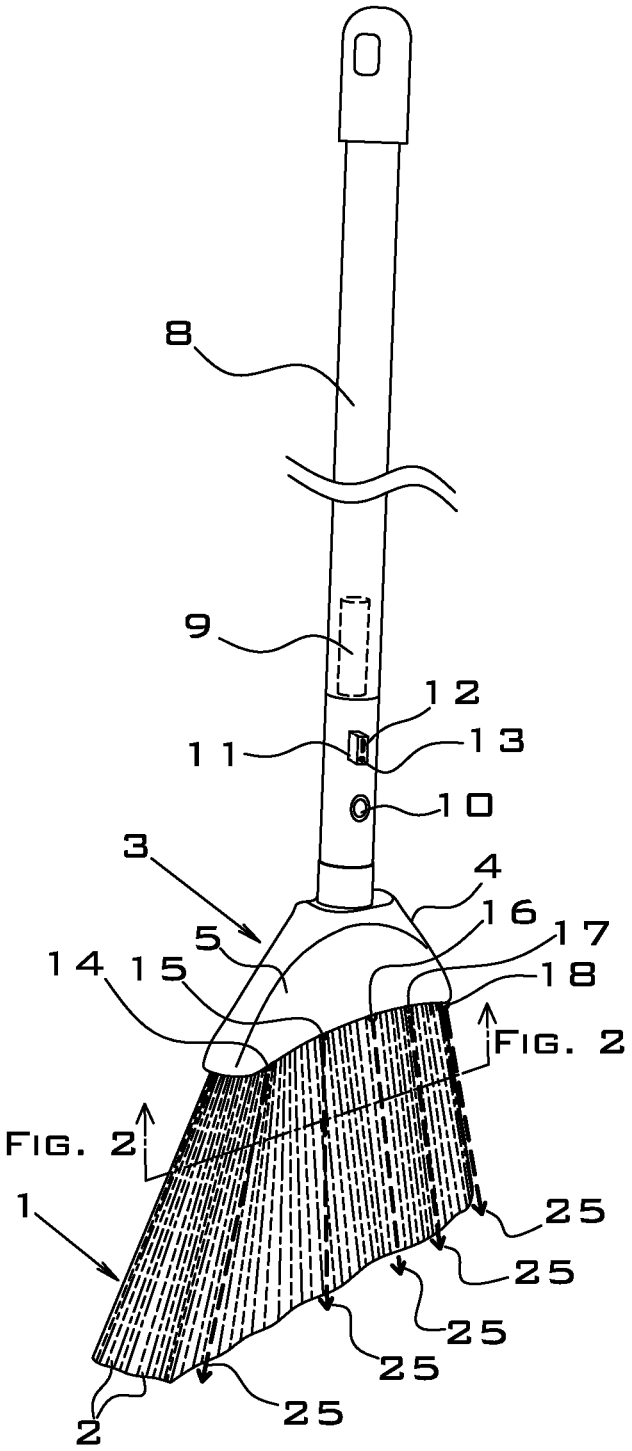
FIGURE 2
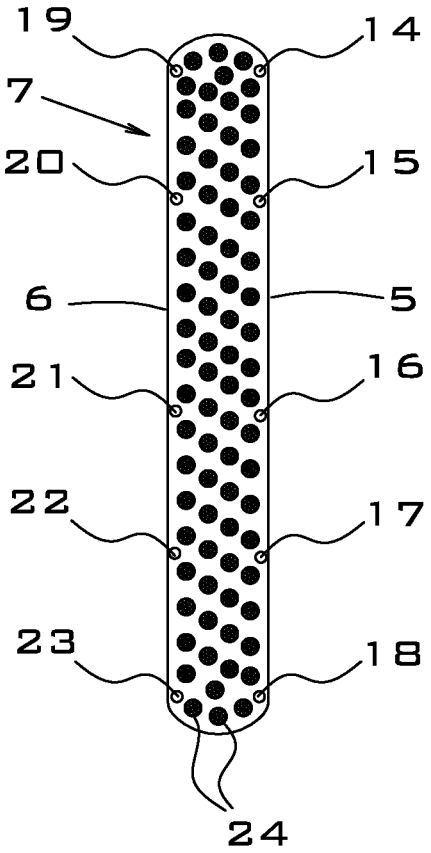
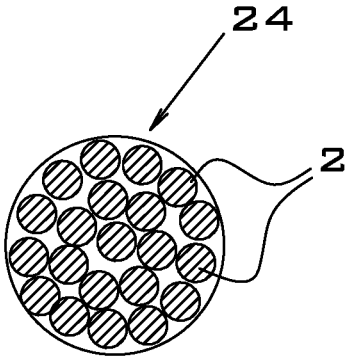
FIGURE 3

BROOM WITH LIGHT

BACKGROUND OF THE INVENTION

1. Field of the Invention

The present invention relates to the field of handheld cleaning tools, and more particularly, to a broom that is equipped with a plurality of multi-directional light-emitting diodes (LEDs).

2. Description of the Related Art

The present invention is a broom that comprises a plurality of LEDs mounted around the perimeter of the bottom face of the brush cap, wherein the center of the beam of visible light from each LED is directed generally toward a work surface, in a direction parallel to adjacent bristles of the broom, thereby providing a lighted area of the work surface that extends from the outer edges of the brush for several inches around the brush. Although there are a number issued patents, patent applications, and non-patented commercial products that are examples of lighted hand tools, none of these examples incorporates the novel features of the present invention.

U.S. Pat. No. 2,168,671 (Garlington, 1939) discloses a safety lamp that is mounted on the top of a tool handle such as a broom so that the user may be detected by passing traffic at night. The safety lamp of this invention is not designed to provide an illuminated work area.

U.S. Pat. No. 7,914,167 (Petersen, 2011) discloses a hand tool such as a sanding tool that incorporates a light that facilitates visual inspection of the surface being modified. In one embodiment, this invention incorporates an array of LEDs that may be positioned circumferentially around the entire periphery of the invention [col 7, line 40] in order to provide "a shallow angle of light incident on the surface being treated." [Col. 7, lines 57-58.] In other words, the light beams from this invention are designed to be emitted near the work surface and oriented close to parallel to the work surface. By contrast, in the present invention, the light beams are emitted from a significant distance above the work surface, and are oriented more perpendicular than parallel to the work surface (i.e., generally downward toward the work surface)

U.S. Pat. No. 8,707,499 (Clark, 2014) discloses a light apparatus that may be attached to a tool such as a flat mop for the purpose of detecting small contaminant particles on a hard surface. In one embodiment, the invention comprises a single LED light source that emits a light beam in a single direction at angle of 0 to 10 degrees measured from the work surface (in other words, approximately horizontal to the work surface). In contrast to the present invention, the Clark invention does not comprise a plurality of lights that emit light at different, preset orientations.

U.S. Pat. No. 9,638,411 (Saltalamacchia, 2017) discloses a light-emitting grip sleeve for a paintbrush. In some embodiments, the invention incorporates a plurality of LED lights that are positioned around the bristles of a paintbrush [FIGS. 5 and 7] and powered by a battery that is rechargeable via a USB port [col. 7, line 19]. As shown in FIGS. 5 and 7, the light beams of each light source are parallel to each other (i.e., the lights beams all emit light that is oriented directly toward the work surface when the paintbrush is oriented perpendicular to the work surface). The light beams from the plurality of lights of the present invention are oriented in different directions, thereby providing a larger illuminated area than would be produced if the lights were oriented in same direction. For example, the central axes of the light beams of the LEDs on the front section of the present invention are oriented downward and forward, while the central axes of the light beams on the rear section of the present invention are oriented downward and rearward, and the and the central axes of the light beams of the central section of the present invention are oriented directly downward, as described in detail below in reference to FIGS. 4-6.

U.S. Pat. No. 9,414,669 (Fleischer, 2016) discloses a light pack for a paint brush and a lighted paintbrush. In some embodiments, the light pack may incorporate a plurality of LEDs that are positioned around the body of a paintbrush [col. 5, lines 42-45]. Unlike the present invention, in which the light beams are oriented in a variety of directions so as to be parallel to adjacent (unbent) brush bristles that are oriented in various directions, the lights of this invention are designed to angle away from the bristles and "aimed to emit light at an angle toward the edge when the bristles are bent" [col. 2, lines 57-58; FIG. 9].

U.S. Pat. No. 9,681,744 (Russell et al., 2017) discloses a toothbrush equipped with ultraviolet lights for detecting tooth plaque or brightening teeth. The invention incorporates one or more ultraviolet light LEDs that are mounted in the bristle field of the toothbrush. Unlike the present invention, the Russell invention does not employ visible-wavelength light to detect particles.

U.S. Patent Application No. 2013/0198991 (Cadigan, 2013) discloses an ultraviolet (UV) light source that may be removably attached to a household cleaning tool such as a broom or vacuum cleaner. The purpose of the UV light is to sanitize the work surface by killing bacteria and other pathogens that are present on the work surface. The light may be removed from the cleaning tool when a cleaning operation is not required to sanitize the work surface.

U.S. Patent Application No. 2009/0059569 (Quattrini, et al. 2009) discloses a lighted cleaning tool in which the light source is fashioned to provide a very low grazing angle of illumination across the surface being cleaned (i.e., nearly parallel to the work surface). The invention may incorporate a light on the front side, the rear side, or both sides, and may comprise an array of LEDs.

U.S. Patent Application No. 2006/0215391 (Jones, et al., 2006) discloses a handheld implement such as a broom that comprises one or more light sources such as LEDs. The light sources are mounted on the shroud portion of the invention, may be installed on multiple sides of the shroud, and may be either set at a fixed direction of illumination or manually adjustable for the direction of illumination [paragraph 0035, lines 10-12]. From inspection of the drawings of the invention, the light sources point generally outward (parallel to the surface being cleaned) and are not capable of being mounted or adjusted so as to point generally downward and perpendicular to the surface being cleaned.

U.S. Patent Application No. 2006/0215390 A1 (Jones, et al., 2006) discloses an invention similar to the invention disclosed in 2006/0215391, with an additional automatic on/off switch for the light source.

BRIEF SUMMARY OF THE INVENTION

The present invention is a broom comprising: (a) brush section that is comprised of a plurality of bristles, each bristle comprising an upper end; a brush cap into which the upper ends of the bristles are mounted; a plurality of white-light LEDs; a shaft comprising a wall; a rechargeable battery; an on/off switch that is mounted to the wall of the shaft and configured to be accessible from an exterior side of the shaft; and a printed circuit board that is mounted within an interior of the shaft proximate to the on/off switch and the rechargeable battery; wherein the brush cap comprises a solid top, solid left side, solid right side, solid bottom, and hollow interior; wherein the rechargeable battery is situated within the hollow interior of the brush cap; wherein the printed circuit board comprises a USB port and a status indicator light; wherein the USB port is positioned adjacent to a first cutout in the wall of the shaft and configured to accept a USB cable from an exterior side of the shaft; wherein the status indicator light is positioned adjacent to a second cutout in the wall of the shaft and configured so that light from the status indicator light is visible from outside of the shaft; and wherein the plurality of white-light LEDs are arranged in two rows, each row consisting of half the total number of LEDs, around a perimeter of a bottom of the brush cap.

In a preferred embodiment, the total number of white-light LEDS is ten; a first five of the white-light LEDs are mounted in a first row along a left edge of the bottom of the brush cap; and a second five of the white-light LEDs are mounted in a second row along a right edge of the bottom of the brush cap. Preferably, the ten white-light LEDs are cylindrical, diffused-lens devices, each having a three-millimeter diameter housing, a brightness of 8000 millcandela, a visible light with a dominant wavelength of 650 nanometers, a viewing angle of about 120 degrees, and an electrical current demand of about 20 milliamps at 3.4 volts DC. The ten white-light LEDs are preferably inserted into holes in the bottom of the brush cap.

In a preferred embodiment, the bristles are attached to the bottom of the brush cap in a plurality of clusters; wherein each cluster of bristles is inserted into a hole in the bottom of the brush cap; wherein the bristles that are located in a front portion of the brush section are angled downward and forward; wherein the bristles that are located in a central portion of the brush section are pointed vertically downward; wherein the bristles that are located in the rear portion of the brush section are angled downward and slightly rearward; and wherein the ten white-light LEDs are mounted into the bottom of the brush cap at preset, individual orientations so that a central axis of a light beam from each LIED is oriented in a direction that is parallel to the bristles that are closest to that particular LED. Preferably, each white-light LED is positioned outside the rows of clusters; and each LED is positioned approximately equidistant from the two nearest clusters to that particular LED. Each white-light LED is preferably configured so that a central axis of a light beam emitted from the LED is set at an individually selected angle with respect to a vertical line that is perpendicular to a horizontal work surface; and all of the light beams are not oriented in the same direction.

In a preferred embodiment, the angle of the central axes of the light beams from the front-most white-light LEDs is set to approximately positive 31 degrees from vertical; wherein the angle of the central axes of the light beams from the rear-most white-light LEDs is set to approximately negative eight degrees from vertical; and wherein the beam angles of the other white-light LEDs are set closer toward vertical than the front-most and rear-most white-light LEDs. Preferably, the white-light LEDs are configured to concentrate more light toward a work surface adjacent to a front side of the broom than to a rear side of the broom. The white-light LEDs are preferably installed in the bottom of the brush cap and configured so that a light-emitting end of each white-light LED is located on an exterior side of the brush cap and terminal wires of each LED are located within an interior of the brush cap.

In a preferred embodiment, the invention further comprises a plurality of resistors; wherein each resistor is coupled to a white-light LED and installed in series; and wherein the resistors are located within an interior of the brush cap. Preferably, the shaft is threadably attached to a top of the brush cap. The status indicator light is a preferably blue-light LED.

BRIEF DESCRIPTION OF THE DRAWINGS

FIG. 1 is a perspective view of the present invention.

FIG. 2 is a bottom view of the brush cap of the present invention.

FIG. 3 is a detail bottom view of one cluster of bristles of the present invention.

REFERENCE NUMBERS

Figure 4:
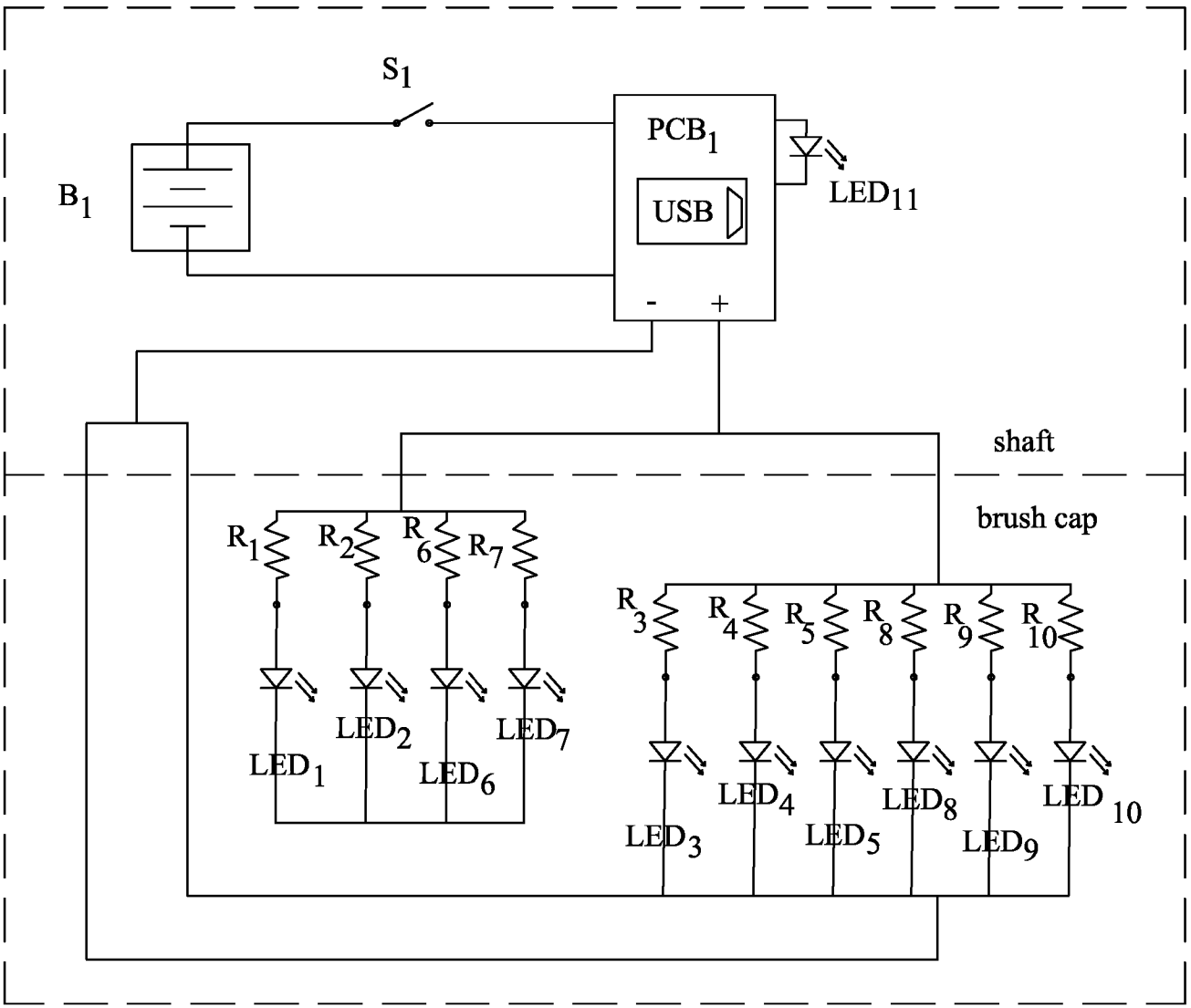
FIG. 4 is a schematic diagram of the electrical circuit of the present invention.

1 Brush section
2 Bristles
3 Brush cap
4 Top of brush cap
5 Left side of brush cap
6 Right side of brush cap
7 Bottom of brush cap
8 Shaft
9 Battery
10 On/off switch
11 Printed circuit board, PCB
12 USB port
13 Status indicator light
14 First white-light LED
15 Second white-light LED
16 Third white-light LED
17 Fourth white-light LED
18 Fifth white-light LED
19 Sixth white-light LED
20 Seventh white-light LED
21 Eighth white-light LED
22 Ninth white-light LED
23 Tenth white-light LED
24 Cluster of bristles
25 Central axis of light beam
26 Interior volume of brush cap
27 Resistor
28 Sleeve
29 Wire

30 Vertical line perpendicular to work surface
31 Horizontal work surface
32 Lighted area

DETAILED DESCRIPTION OF INVENTION

The present invention is a broom that provides an illuminated zone to a work area such as a floor. The illuminated zone extends around the front, sides, and rear of the brush section of the broom and enables a user to visually identify dirt particles and other debris that would otherwise be difficult to see. In a preferred embodiment, the broom incorporates a total of eleven LED devices, including ten white-light LEDs for floor illumination and one blue-light LED that serves as a status indicator.

FIG. 1 is a perspective view of the present invention. As shown, the present invention comprises a brush section 1 that is comprised of a plurality of bristles 2 whose upper ends are mounted into a brush cap 3. The brush cap 3 is preferably manufactured from injection-molded polymer with a solid top 4, solid left side 5, solid right side 6 (shown in FIG. 2), solid bottom 7 (shown in FIG. 2), and hollow interior (shown in FIG. 5). The present invention further comprises a shaft 8, preferably manufactured from aluminum tubing with a polymer bottom cap, that is threadably attached to the top 4 of the brush cap 3, a cylindrical, rechargeable battery 9 (shown in phantom) that is positioned within the hollow interior of the shaft 8, an on/off switch 10 that is mounted to the wall of the shaft 8 and accessible from the exterior of the shaft 8, and a printed circuit board (PCB) 11 (shown in phantom) that is mounted within the interior of the shaft 8. The PCB 11 comprises a USB port 12 and a status indicator light 13. The USB port 12 is positioned adjacent to a first cutout in the wall of the shaft 8 so that a USB cable (not shown) may be connected to the USB port 12 from the exterior side of the shaft 8. The status indicator light 13 is positioned adjacent to a second cutout in the wall of the shaft 8 so that light from the status indicator light 13 is visible from outside the shaft 8. In a preferred embodiment, the status indicator light 13 is a blue-light LED.

FIG. 2 is a bottom view of the brush cap 3, showing the positions of the ten white-light LEDs 14-23 that are mounted around the perimeter of the bottom 7 of the brush cap 3. In a preferred embodiment of the present invention shown in FIGS. 1 and 2, five identical white-light LEDs (first white-light LED 14, second white-light LEE) 15, third white-light LED 16, fourth white-light LED 17, and fifth white-light LED 18) are mounted in a first row along the left edge of the bottom 7 of the brush cap 3, and an additional five identical white-light LEDs (sixth white-light LED 19, seventh white-light LED 20, eighth white-light LED 21, ninth white-light LED 22, and tenth white-light LE 23) are mounted in a second row along the right edge of the bottom 7 of the brush cap 3. The ten white-light LEDs 14-23 are preferably cylindrical, diffused-lens devices, each having a three-millimeter diameter housing (aka type T1), a brightness of 8000 millicandela, a visible light with a dominant wavelength of 650 nanometers, a viewing angle of about 120 degrees, and an electrical current demand of about 20 milliamps at 3.4 volts DC typical. One example of a suitable LED device for first through tenth white-light LEDs 14-24 is SKU #2174881 sold by Jameco Electronics of Belmont, Calif. (Jameco-.com). The ten white-light LEDs 14-23 are preferably inserted into holes that are drilled or otherwise manufactured into the bottom 7, and these LEDs may be rigidly fixed within the holes with adhesive.

In a preferred embodiment, the battery 9 is a rechargeable, 2200 milliamp-hour, five-volt, lithium-ion battery, and the battery 9 and battery-charging PCB 11 are purchased as a set (for example, SKU #42985320 sold by LifeandHome.com of Brooklyn, N.Y.). The on/off switch 10 is preferably a single-pole, single-throw, latching push button switch.

As shown in FIG. 2, the bristles 2 are preferably attached to the bottom 7 of the brush cap 3 in a plurality of approximately seventy-eight clusters 24, wherein each cluster 24 of bristles 2 contains a plurality of approximately twenty-one bristles 2 bundled together and cemented into round holes of approximately 0.175 inch diameter in the bottom 7. As shown in FIG. 1, the portion of the bristles 2 that are located near the front portion of the brush section 1 (the left side of the brush section 1 in FIG. 1) are angled downward and forward, while the portion of the bristles 2 that are located near the central portion of the brush section 2 are pointed vertically downward, and the portion of the bristles 2 of the brush section 1 that are located near the rear portion of the brush section 1 are angled downward and slightly rearward. The angle of each cluster of bristles is set by the orientation of the hole into which the bristles 2 are bundled. The ten white-light LEDs 14-23 are preferably mounted into the bottom 7 of the brush cap 3 at preset, individual orientations so that the central axis 25 of the light beam from each of the LEDS is oriented in a direction that is parallel to the bristles 2 that are closest to that particular LED. FIG. 1 illustrates the central axes 25 (shown by dashed arrows) of the light beams emitted by the first through fifth white-light LEDs 14-18. As shown in FIG. 2, each LED 14-23 is positioned outside of the rows of clusters 24, and each LED 14-23 is positioned approximately equidistant from its two nearest clusters 24. Also as shown, the second LED 15 and seventh LED 20 are located closer to the two front LEDs (first a LED 14 and sixth LED 19, respectively) than to the other pair of adjacent LEDs (third LED 16 and eighth LED 21, respectively), thereby concentrating more light toward the work surface adjacent to the front side of the broom.

FIG. 3 is a detail bottom view of one cluster 24, illustrating twenty-one identical bristles 2 bundled into a cluster 24.

FIG. 4 is a schematic diagram of the electrical circuit of the present invention. Components shown in FIG. 4 correspond to the reference numbers shown in the other figures as follows:

$LED_1$ through $LED_{10}$ correspond to first through tenth white-light LEDs 14-23.

LED 11 corresponds to status indicator light 13.

$B_1$ corresponds to battery 9.

$PCB_1$ corresponds to printed circuit board 11.

S1 corresponds to on/off switch 10.

$R_1$ through $R_{10}$ correspond to resistors 27.

USB corresponds to USB port 12.

As shown in FIG. 4, each of the white-light LEDs ($LED_1$ through $LED_{10}$) has a resistor ($R_1$ through $R_{10}$) installed in series. The purpose of these resistors is to reduce the voltage applied to each of these LEDs, thereby prolonging the operating life of the LEDs. In a preferred embodiment, each of the resistors $R_1$ through $R_{10}$ is a carbon film, ¼ watt, 150 ohm, 5% resistor.

The status indicator light $LED_{11}$, which is controlled by the circuitry mounted on the printed circuit board $PCB_1$, has the following indicating modes:

(1) When the switch $S_1$ is in the ON position, the floor-illuminating, white-light LEDs ($LED_1$ through $LED_{10}$), are turned on, and $LED_{11}$ flashes three times, pauses, and repeats the sequence indefinitely, to indicate that the electrical circuit is on.

(2) When the switch $S_1$ is in the OFF position, and the battery $B_1$ is not being recharged, the floor-illuminating, white light LEDs ($LED_1$ through $LED_{10}$) are turned off, and $LED_{11}$ is also turned off, indicating that the electrical circuit is off.

(3) When switch St is off, and an energized USB cable is connected to the USB port, and the battery $B_1$ requires charging, $LED_{11}$ flashes three times, pauses, and repeats the sequence indefinitely, to indicate $B_1$ is being charged.

(4) When switch $S_1$ is off, and an energized USB cable is connected to the USB port, and the battery $B_1$ is fully charged. $LED_{11}$ is continuously lit, thereby indicating that the battery $B_1$ is fully charged.

The dashed rectangles shown in FIG. 4 indicate which of the electrical components are located in the shaft 8 and which are located in the brush cap 3 of the present invention.

Figure 5:
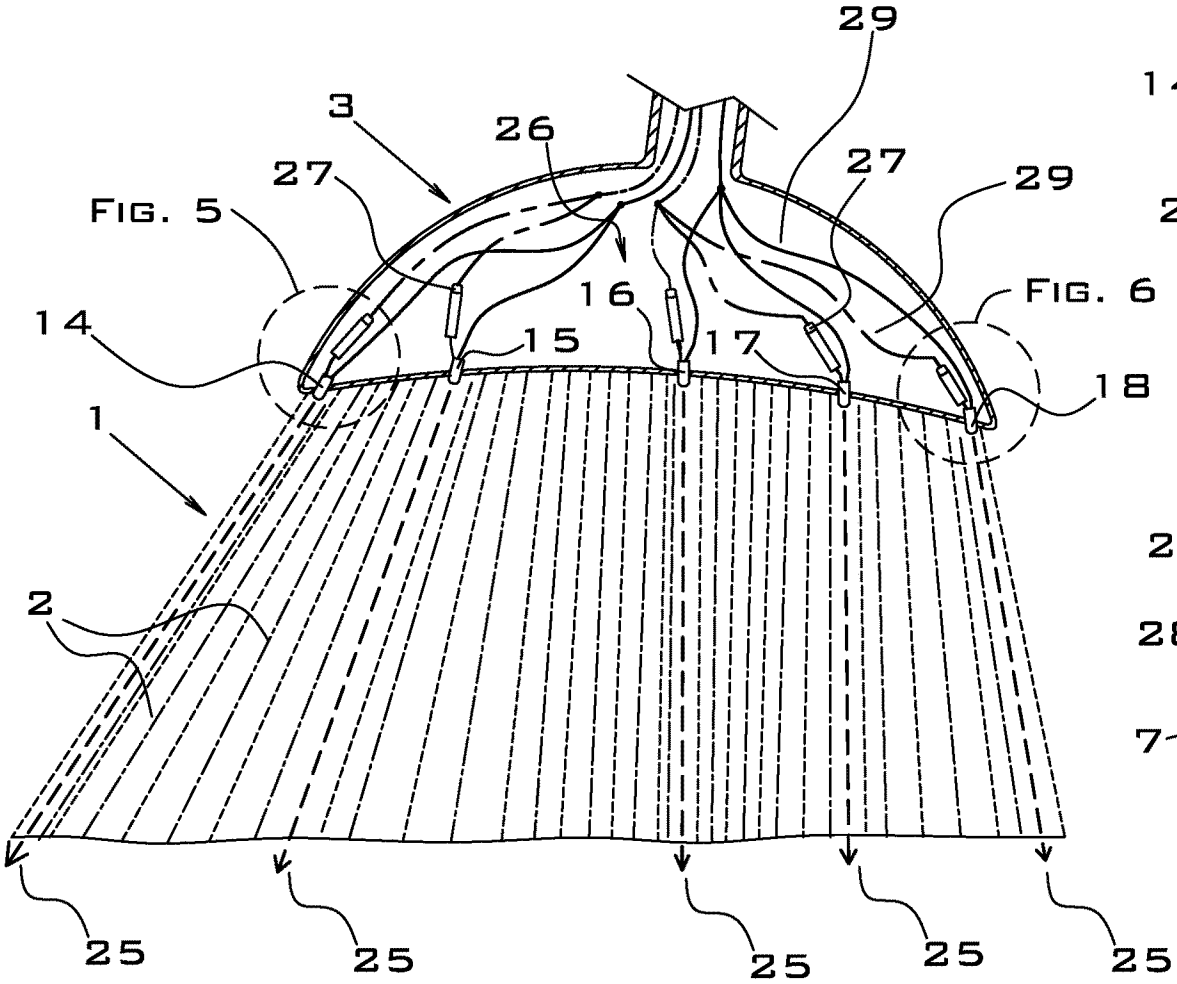
FIG. 5 is left side elevation view of the brush section and brush cap of the present invention with the left side of the brush cap removed to show the electrical components
Figure 8:
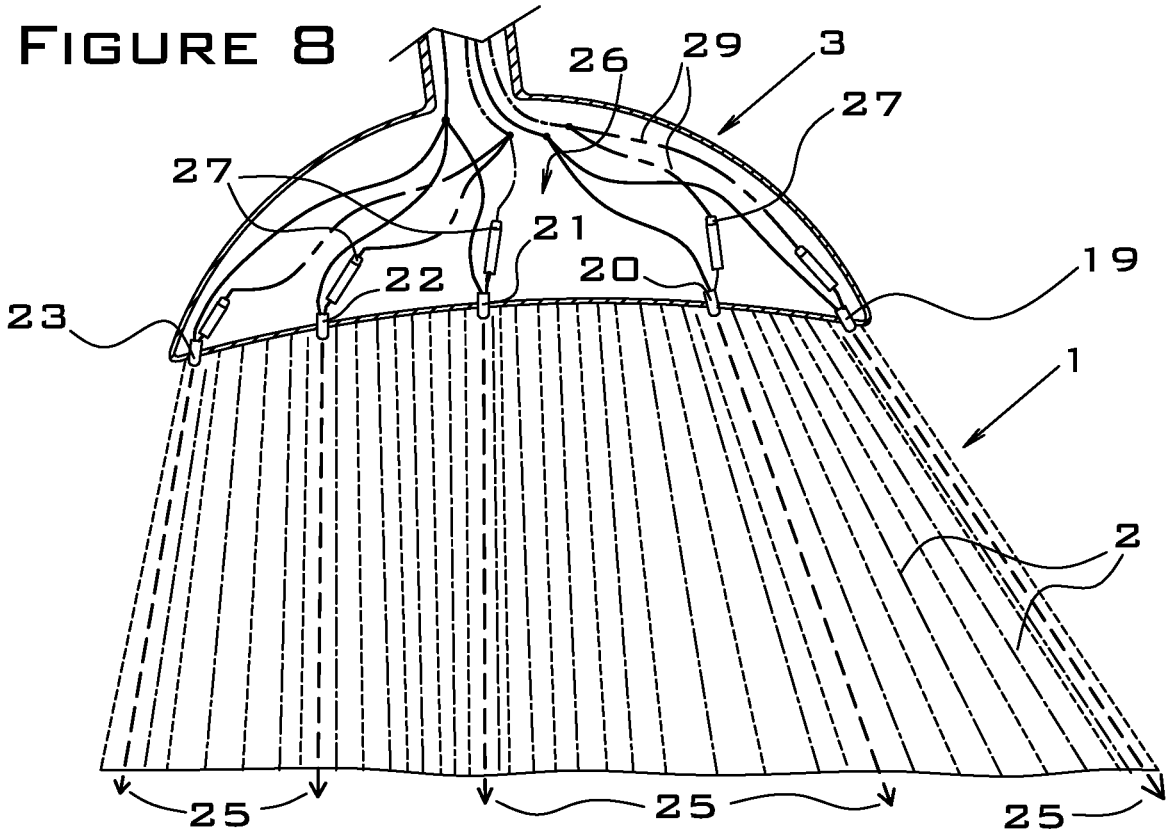
FIG. 8 is right side elevation view of the brush section and brush cap of the present invention with the right side of the brush cap removed to show the electrical components.

FIG. 5 is left side elevation view of the brush section 1 and the brush cap 3 of the present invention with the left side of the brush cap 3 removed to show the electrical components (which comprise the first through fifth white-light LEDs 14-18) that are a mounted within the left half of the hollow interior space 26 of the brush cap. (In this view, the sixth though tenth white-light LEDs 19-23 and their associated resistors and wiring are located behind the components shown, have been removed from FIG. 4 for clarity, and are shown in FIG. 8.) The direction of the central axis 25 of the light beam of each of the white-light LEDs 14-18 is illustrated by dashed arrows. As shown, each of the white-light LEDS 14-18 is connected to a series resistor 27. Silicone-insulated, 300 volt, 30 AWG copper wire 29, temperature rated at −60 to −150 degrees Celsius is preferably used to connect the components. One example of a suitable commercially-available wire is ASIN # B01KQ2JNLI sold by Striveday on Amazon.com. Optionally, positive wiring (shown as dash-dot lines in FIG. 5) may have red-colored insulation, while negative wiring (shown as solid lines in FIG. 5) may have black-colored insulation, as an aid to assembly. All wiring connections are joined by soldering.

Figure 6:
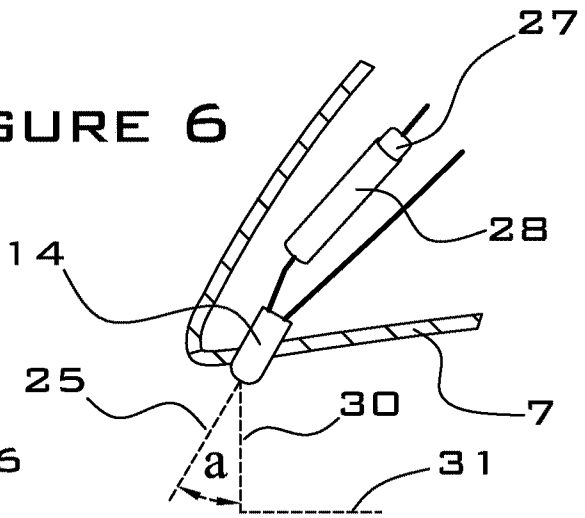
FIG. 6 is a magnified detail view of the first white-light LED with an attached series resistor.
Figure 7:
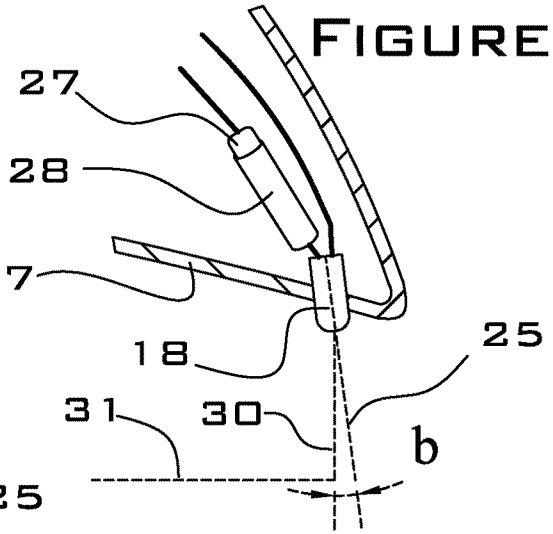
FIG. 7 is a magnified detail view of the fifth white-light LED with an attached series resistor.

FIG. 6 is a magnified detail view of the first white-light LED 14 with an attached series resistor 27, and FIG. 7 is a magnified detail view of the fifth white-light LED 18 with an attached series resistor 27, with both details taken at the locations shown by dashed circles in FIG. 5. As shown most clearly in FIGS. 6 and 7, the white-light LEDs are installed into and through the bottom 7 of the brush cap 3 so that the light-emitting end of each white-light LED is located on the exterior side of the brush cap 3, while the terminal wires of each of these LEDs are located within the interior of the brush cap 3. Also shown in FIGS. 6 and 7 are the resistors 27 that are connected in series with each LED and located within the interior of the brush cap 3. In a prototype version of the present invention, each of the resistors 27 is encased within a polymer sleeve 28, as shown in FIGS. 6 and 7, but these sleeves may optionally be omitted in mass-production versions of the present invention. As illustrated in the comparison of Angle a in FIG. 6 to Angle b in FIG. 7, each LED is mounted so that the central axis 25 of the light beam emitted from each LED is set at a particular individually selected angle with respect to a vertical line 30 that is perpendicular to the horizontal work surface 31, rather than all of the light beams being oriented in the same direction.

As described previously in reference to FIG. 1, the mounting angle of each LED is set so that the central axis 25 of that light beam is parallel to the bristles 2 that are adjacent to that LED. As shown in FIG. 2, the right row of white-light LEDs 19-23 is approximately a mirror image of the left row of LEDs 14-18; therefore, the mounting angle of LED 19 is approximately the same as the mounting angle for LED 14, the mounting angle for LED 20 is approximately the same as for LED 15, the mounting angle for LED 21 is approximately the same as the mounting angle for LED 16, the mounting angle for LED 22 is approximately the same as for LED 17, and the mounting angle for LED 23 is approximately the same as for LED 18. In a preferred embodiment, the angle of the central axes of the light beams from the front-most white-light LEDs 14 and 19 (Angle a) is set to approximately 31 degrees from vertical, pointed toward the forward end of the broom, and the angle of the central axes of the light beams from the rear-most white-light LEDs 18 and 23 (Angle b) is set to approximately 8 degrees from vertical, pointed toward the rearward end of the broom. The beam angles from the other six white-light LEDs are set more toward vertical (smaller angles of deviation from vertical) than the beam angles of the front-most and rear-most white-light LEDs, as illustrated in FIG. 5. In summary, the angles of the central axes of the light beams from the white-light LEDs 14-18 are set at individual angles that cover a range of approximately positive 31 degrees to negative 8 degrees as measured from vertical, where the positive direction refers to angles that are forward of vertical, and the negative direction refers to angles that are rearward of vertical.

Figure 9:
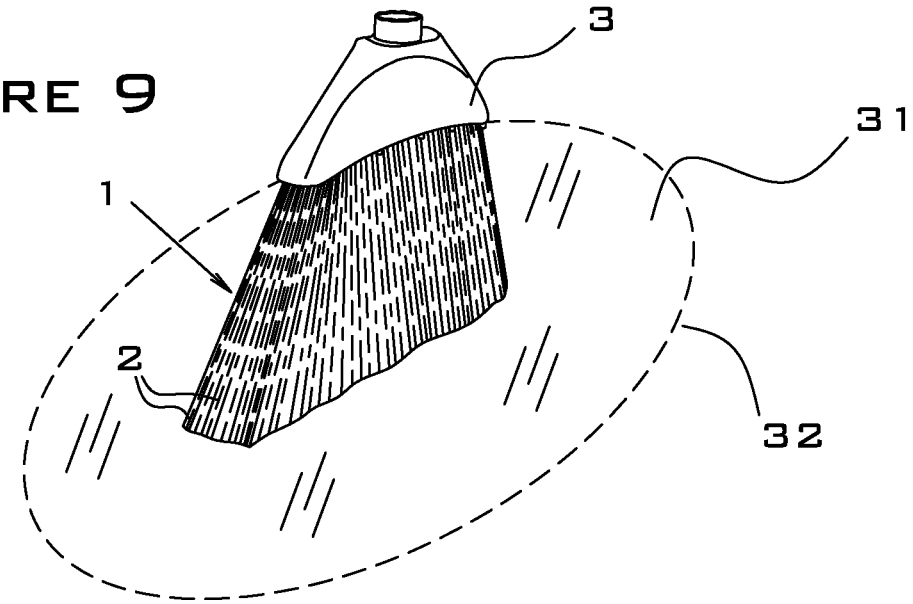
FIG. 9 is a perspective view of the brush section and brush cap of the present invention, illustrating the approximate extent of the lighted area that shines on a work surface when the ten white-light LEDs are turned on and the bristles are in contact with the work surface.

FIG. 8 is right side elevation view of the brush section 1 and the brush cap 3 of the present invention with the right side of the brush cap 3 removed to show the electrical components (which comprise the sixth through tenth white-light LEDs 19-23) that are mounted within the right half of the hollow interior volume 26 of the brush cap 3. (In this view, the first though fifth white-light LEDs 14-18 and their associated resistors and wiring are located behind the components shown and have been removed for clarity.) FIG. 9 is a perspective view of the brush section 1 and brush cap 3 of the present invention, illustrating the approximate extent of the generally elliptically-shaped lighted area 32 that illuminates a horizontal work surface 31 when the ten white-light LEDs are turned on and the bristles 2 are in contact with the work surface. Empirical measurements indicate that the lighted area 32 extends approximately 6 inches beyond the perimeter of the bristles 2 when the bristles 2 are in contact with a work surface and that the lighted area extends to about 24 inches outside of the perimeter of the bristles 2 when the broom is lifted vertically so that the bristles 2 are raised about 12 inches above the work surface. In a preferred embodiment with ten white-light LEDs, the total white-light output of the present invention is 80,000 millicandela.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A broom comprising:

(a) a brush section that is comprised of a plurality of bristles, each bristle comprising an upper end;

(b) a brush cap into which the upper ends of the bristles are mounted;

(c) a plurality of white-light LEDs;

(d) a shaft comprising a wall;

(e) a rechargeable battery;

(f) an on/off switch that is mounted to the wall of the shaft and configured to be accessible from an exterior side of the shaft; and (g) a printed circuit board that is mounted within an interior of the shaft proximate to the on/off switch and the rechargeable battery;

wherein the brush cap comprises a solid top, solid left side, solid right side, solid bottom, and hollow interior;

wherein the rechargeable battery is situated within the interior of the shaft;

wherein the printed circuit board comprises a USB port and a status indicator light;

wherein the USB port is positioned adjacent to a first cutout in the wall of the shaft and configured to accept a USB cable from an exterior side of the shaft;

wherein the status indicator light is positioned adjacent to a second cutout in the wall of the shaft and configured so that light from the status indicator light is visible from outside of the shaft; and wherein the plurality of white-light LEDs are arranged in two rows, each row consisting of half the total number of LEDs, around a perimeter of the bottom of the brush cap.

2. The broom of claim 1, wherein the total number of white-light LEDS is ten;

wherein a first five of the white-light LEDs are mounted in a first row along a left edge of the bottom of the brush cap; and wherein a second five of the white-light LEDs are mounted in a second row along a right edge of the bottom of the brush cap.

3. The broom of claim 1, wherein the white-light LEDs are cylindrical, diffused-lens devices, each having a three-millimeter diameter housing, a brightness of 8000 millicandela, a visible light with a dominant wavelength of 650 nanometers, a viewing angle of about 120 degrees, and an electrical current demand of about 20 milliamps at 3.4 volts DC.

4. The broom of claim 1, wherein the white-light LEDs are inserted into holes in the bottom of the brush cap.

5. The broom of claim 1, wherein the bristles are attached to the bottom of the brush cap in a plurality of clusters;

wherein each cluster of bristles is inserted into a hole in the bottom of the brush cap;

wherein the bristles that are located in a front portion of the brush section are angled downward and forward;

wherein the bristles that are located in a central portion of the brush section are pointed vertically downward;

wherein the bristles that are located in a rear portion of the brush section are angled downward and slightly rearward; and wherein the white-light LEDs are mounted into the bottom of the brush cap at preset, individual orientations so that a central axis of a light beam from each LED is oriented in a direction that is parallel to the bristles that are closest to that particular LED.

6. The broom of claim 5, wherein each white-light LED is positioned outside the rows of clusters; and wherein each LED is positioned approximately equidistant from the two nearest clusters to that particular LED.

7. The broom of claim 1, wherein each white-light LIED is configured so that a central axis of a light beam emitted from the LED is set at an individually selected angle with respect to a vertical line that is perpendicular to a horizontal work surface; and wherein all of the light beams are not oriented in the same direction.

8. The broom of claim 7, wherein the angle of the central axes of the light beams from the front-most white-light LEDs is set to approximately positive 31 degrees from vertical;

wherein the angle of the central axes of the light beams from the rear-most white-light LEDs is set to approximately negative eight degrees from vertical; and wherein the beam angles of the other white-light LEDs are set closer toward vertical than the front-most and rear-most white-light LEDs.

9. The broom of claim 1, wherein the white-light LEDs are configured to concentrate more light toward a work surface adjacent to a front side of the broom than to a rear side of the broom.

10. The broom of claim 1, wherein the white-light LEDs are installed in the bottom of the brush cap and configured so that a light-emitting end of each white-light LED is located on an exterior side of the brush cap and terminal wires of each LED are located within the interior of the brush cap.

11. The broom of claim 1, further comprising a plurality of resistors:

wherein each resistor is coupled to a white-light LED and installed in series; and wherein the resistors are located within the interior of the brush cap.

12. The broom of claim 1, wherein the shaft is threadably attached to the top of the brush cap.

13. The broom of claim 1, wherein the status indicator light is a blue-light LED.

* * * * *